US009279174B2

(12) United States Patent
Kulakovsky

(10) Patent No.: US 9,279,174 B2
(45) Date of Patent: Mar. 8, 2016

(54) UNIT FOR APPLYING THE COATINGS ON ELONGATE PRODUCTS

(76) Inventor: Aleksandr Aleksandrovich Kulakovsky, Moscow (RU)

( * ) Notice: Subject to any disclaimer, the term of this patent is extended or adjusted under 35 U.S.C. 154(b) by 0 days.

(21) Appl. No.: 14/351,938

(22) PCT Filed: Nov. 18, 2011

(86) PCT No.: PCT/RU2011/000910
§ 371 (c)(1),
(2), (4) Date: Jul. 9, 2014

(87) PCT Pub. No.: WO2013/062436
PCT Pub. Date: May 2, 2013

(65) Prior Publication Data

US 2015/0040825 A1 Feb. 12, 2015

(30) Foreign Application Priority Data

Oct. 25, 2011 (RU) ..... 2011142853

(51) Int. Cl.

| | |
|---|---|
| ***B05C 3/02*** | (2006.01) |
| ***C23C 2/00*** | (2006.01) |
| ***C23C 2/36*** | (2006.01) |
| ***C23C 2/12*** | (2006.01) |
| ***C23C 2/38*** | (2006.01) |

(52) U.S. Cl.
CPC . *C23C 2/003* (2013.01); *C23C 2/12* (2013.01); *C23C 2/36* (2013.01); *C23C 2/38* (2013.01)

(58) Field of Classification Search
USPC ..... 118/405, 419, 420, 429; 427/431; 164/457, 119
See application file for complete search history.

(56) References Cited

U.S. PATENT DOCUMENTS

| | | | | |
|---|---|---|---|---|
| 5,262,033 | A * | 11/1993 | Zega et al. | 204/298.37 |
| 5,494,262 | A * | 2/1996 | McLane et al. | 266/45 |
| 2006/0153992 | A1 * | 7/2006 | Tenckhoff et al. | 427/431 |

* cited by examiner

*Primary Examiner* — Yewebdar Tadesse
(74) *Attorney, Agent, or Firm* — McKee, Voorhees & Sease, PLC

(57) ABSTRACT

The coating unit for elongate components comprises a tank with molten metal and a coating chamber with inlet and outlet channels with an intake channel submerged into the tank with molten metal. Moreover, the coating chamber and the tank with molten metal are equipped with facilities for internal creation inside them above the heel reduced pressure and positive pressure respectively. To facilitate the operation and maintenance, as well as to ensure continuous operation of this unit without any stops for refilling the tank, to provide safety conditions while metal refilling into the tank with molten metal of this unit for coating of elongate components, the tank with molten metal and coating chamber are located in adjacent positions and jointed together with the inclined intake channel creating connecting vessels. Herewith, the tank with molten metal is equipped with supplying channel to load molten or solid metal through it, besides the supplying channel expands at the upper part entering the upper part of the tank with molten metal.

9 Claims, 1 Drawing Sheet

UNIT FOR APPLYING THE COATINGS ON ELONGATE PRODUCTS

CROSS-REFERENCE TO RELATED APPLICATIONS

Figure 1:
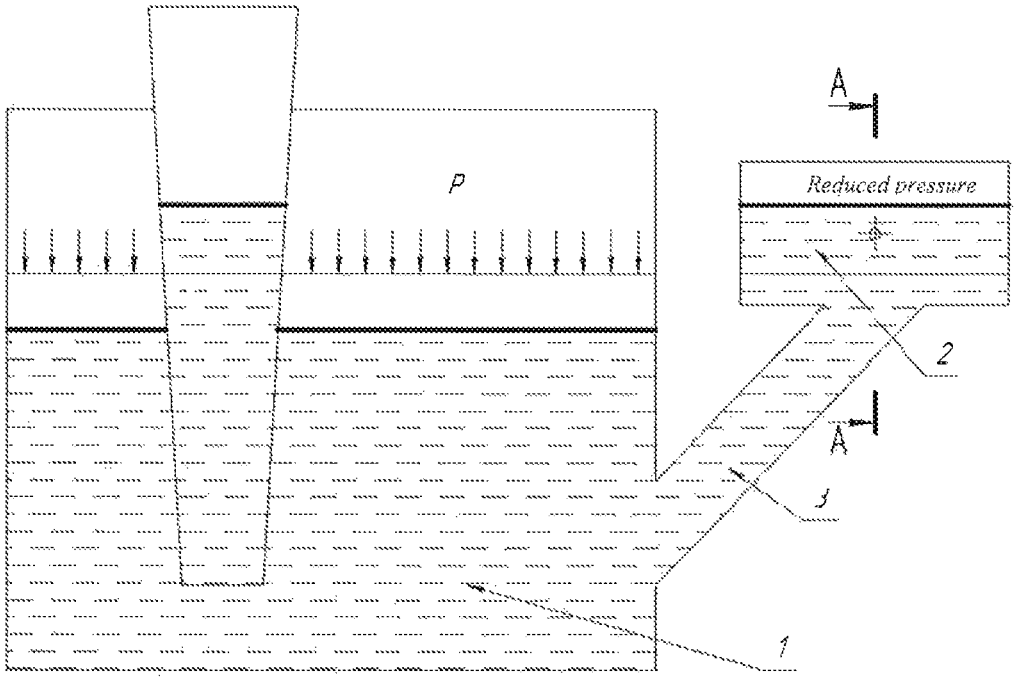

This is a National Phase application claiming priority to PCT/RU2011/000910 filed Nov. 18, 2011, which claims priority to RU 2011142853 filed Oct. 25, 2011, all of which are herein incorporated by reference in their entireties.

This invention refers to refer to technological equipment for continuous metal protecting coat application on surfaces of elongate components such as wire, strips, etc., by its immersion into molten aluminium, zinc, stannum, lead, etc. This invention could be used for hot aluminizing, galvanizing or galvaluming of lengthy components made of cast iron or steel.

The known units are designed for coating of wire, strips, etc., which contains guide roll immersing the component into the molten metal and moving the component (see Hot Galvanizing Guidance.—Moscow, Metallurgiya, 1975, p. 376; Metal-Coated Sheet and Strip Steel.—Moscow, Metallurgiya, 1971, p. 496).

The disadvantage of the known units using the steel tanks is the big capacity of the steel tanks and significant open heel area causing big energy costs to maintain the temperature of the molten metal.

The contact with components of immersed handlers (rolls, clamps, etc.) leads to iron dissolution in zinc and thereby it reduces the lifetime of equipment and increases the zinc consumption.

Application of the steel tank with immersed handler eliminates the possibility of molten metal alloying with aluminium. In spite of the fact that ceramic tanks are resistant to molten aluminium, their capacity is bigger if compared with the metal ones which are heated through the walls, in the ceramic tanks the heating process is conducted through the heel and this results in increasing the capacity.

A unit intended for application of protective coating onto the elongate components is available that is equipped with a tank and heating elements, as well as passage opening in the tank bottom, magneto hydrodynamics lock (MHD-lock) located below the passage opening, with a flange partially introduced into the tank through the opening. The HMD-lock is designed as two L-type magnetic cores with one-phase circuit winding in the shape of flat coils located on the vertical magnetic core legs (SU 1492759, 15 Mar. 1994).

The disadvantage of this unit is its complexity because of MHD-lock usage.

A unit designed for metal coating of elongate components is available that is equipped with a tank containing molten metal and a coating chamber (FR 197516981, 1975). The coating chamber comprises inlet and outlet channels which the components are moved through while coating. The molten metal is transferred from the tank into the coating chamber by means of a pump. The chamber is filled with metal so that the molten metal level in the chamber is set higher than the level of inlet and outlet channels. At this moment the molten metal flows out of the chamber freely into the tank, but the amount of the molten metal put in the chamber back is a little bit bigger than the amount of the metal flowing out of the chamber through the inlet and outlet channels. This enables maintaining the molten metal level in the coating chamber above the levels of the inlet and outlet channels.

The disadvantage of this unit is that the molten metal is supplied using the submerged pump and this results in reduction of reliability index required from the industrial equipment. Continuous circulation of the molten metal causes the rapid wear of the channels, and the molten metal is contaminated with materials the channels are made of this worsens the coat formation conditions, and consequently leads to lowering of its quality. Herewith, the molten aluminium usage is quite problematic due to its corrosive power.

The closest technical analogue to the unit proposed is a unit for component surface process, more specifically, for coating application. This unit comprises a tank with molten metal (alloy) and, above the tank, a coating chamber with inlet and outlet channels and vertical intake channel immersed into the molten metal in the tank. To lift the molten metal up along the intake channel into the coating chamber, the positive pressure is generated in the tank and reduced pressure in the coating chamber. The pressure difference in the cavities above the chamber and tank surfaces allows molten metal level to exceed the inlet and outlet openings of the chamber. Vacuum of the coating chamber also serves to prevent molten metal leakage from the coating chamber. Herewith, the following condition shall be satisfied:

$$P_{st} \geq P_1 + P_{m.col.},$$

where $P_{st}$—standard pressure $P_1$—pressure in the coating chamber $P_{m.col.}$—pressure of the molten metal column above the lower channel guide.

During the coating process the pressure difference, $\Delta = P_{st} - (P_1 + P_{m.col.})$, is maintained at a constant level to avoid any leakage of the molten metal and air penetration inside the chamber through the inlet and outlet channels.

The disadvantage of this unit is that the coating chamber intake channel submerged into the molten metal is located vertically and this requires location of a coating chamber right above the tank with molten metal. Such a mutual alignment of the coating chamber and tank connected by the vertical channel, firstly, obstructs the unit maintenance and ensure no safety operation as any process stages related to wire loading, correction of some faults, are conducted in the area of high temperature, and forced usage of cooling loops will increase the risks of emergency situations; secondly, it requires regular stops of the line to apply some coat containing the coating unit proposed due to the fact that compensation of consumed molten metal added into the tank is possible only when the coating chamber is drained dry from the molten metal that results in reduced capacity and in increased energy costs. Tank refilling is impossible without stopping the unit operation and without releasing the positive pressure as when the tank is opened the positive pressure will displace the molten metal in the tank over its lid and that is unacceptable.

This unit helps to solve the issue related to safety, convenience and facilitation of the unit maintenance both during operation of the unit and during the tank refilling with molten metal, to energy costs reduction and to increase of the unit work output.

This task is solved due to the fact that the unit for coat application of elongate components consists of a tank with molten metal and a coating 10 chamber with inlet and outlet channels, an intake channel submerged into the tank with molten metal; moreover, the coating chamber and tank with molten metal are equipped with devices intended for creation inside the tank and chamber above the heel of metal positive pressure and reduced pressure respectively. Herewith, the molten metal tank is equipped with a supplying 15 channel to fill it with the consumed molten or solid metal. To ensure extra safety, the supplying channel expands at its upper part entering the tank with molten metal.

The technical result of this unit usage is the increase of convenience and safety of the operation, easy maintenance, provision of the continuous operation without any stops for refilling the tank, provision of safety when the tank is refilled with molten metal, as well as reduction of energy costs and increase of the unit work output.

This technical result is determined by the significant features of this unit. The location of the coating chamber adjacent to the tank with molten metal facilitates the access to the coating chamber and to the equipment ensuring its operation (temperature control system, pressure sensor, molten metal level sensor, gas knives to remove the excess of molten metal, etc.).

At the same time this feature enables reduction of energy costs for molten metal lifting from the tank into the coating chamber due to location of the chamber above the tank in such a manner that they form the connecting vessels; reduction of the amount of positive pressure generated above the molten metal in the tank. Adjacent location of the coating chamber and tank for molten metal (without interpenetration of tank lid by the chamber) allows refilling the tank to compensate the molten metal consumed without necessity to stop the process of the coating application that reduces the energy costs for molten metal heating in the tank (no heat losses when the unit operation is aborted and the lid is opened). To refill the tank, the supplying channel is provided for. This appliance is submerged into the tank below the molten metal that allows opening the lid of the supplying channel and filling the additional batches of the molten or solid metal (alloy) directly into the molten metal in the tank without stopping the unit operation. Herewith, the safety is ensured as the positive pressure above the heel in the tank will displace the molten metal up along the supplying channel due to the pressure difference but not higher than the level of the molten metal in the coating chamber where the pressure is below the standard value. Whereby, no leakages of molten metal over the supplying channel are possible also due to its expanded shape of the upper part of the supplying channel.

The invention is explained on the drawing where the following is demonstrated:

FIG. 1. Schematic Layout of Unit for Applying the Coatings on Lengthy Products.

Figure 2:
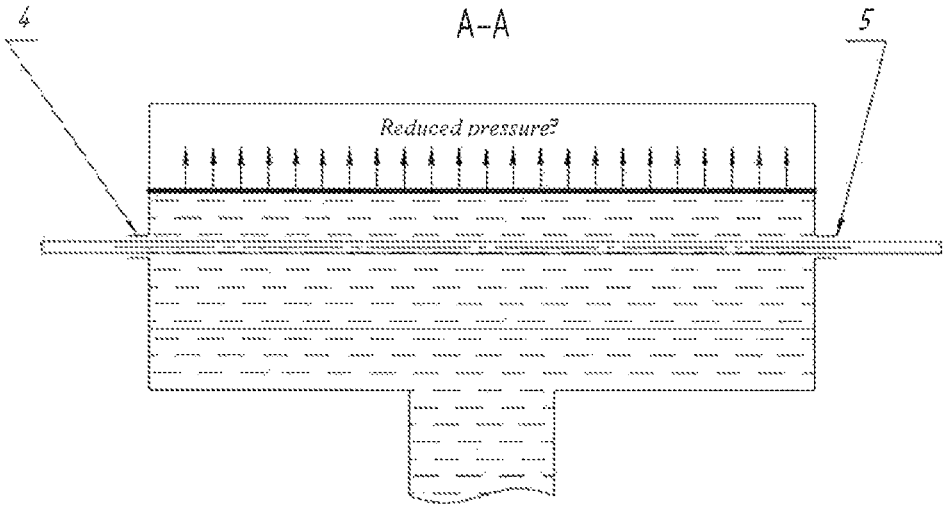

FIG. 2. FIG. 1 Section A-A.

The unit for applying the coatings on lengthy products, e.g., onto steel wires, consists of a tank with molten metal 1 that is an electrical furnace for metal melting and soaking at a set temperature, and a coating chamber 2 located close to the tank. The coating chamber 2 is equipped with an inclined channel 3 connecting the coating chamber 2 and the tank with molten metal 1 to the inlet 4 and outlet 5 channels in the side walls of the coating chamber 2. These channels could be, for example, horizontal. At the operation position the tank with molten metal 1, coating chamber 2 and inclined channel are sealed to exclude the contact of the molten metal with ambient air. The upper part of the inclined channel 3 opens inside the coating chamber 2 through the opening at the bottom or through the opening in the side wall close to the bottom, and the lower part of the inclined channel 3 is connected to the cavity of tank with molten metal 1 below the possible molten metal level. Moreover, the inclined intake channel 3 is designed so that it excludes the contact of the air cavity above the heel in the tank 1 and coating chamber 2.

Molten metal can move along the inclined channel 3 up from the tank with molten metal 1 and fill the coating chamber 2 up to the set level.

Through the horizontal channels, inlet 4 and outlet 5, wire or any other long components are moved through the molten metal in the coating chamber 2 to create the coating on wire.

The upper removable lid of the coating chamber 2 is equipped with molten metal level control sensors, pressure sensor, and reduced pressure creation device.

The upper removable lid of the chamber 2 is equipped with molten metal level control sensors, pressure gauge and outtake channel with outtake manifold connected to the vacuum pump generating reduced pressure. It is possible to generate reduced pressure using the ejector. The outtake manifold is installed on the coating chamber 2 wall. The maintenance of sensors and equipment located on the coating chamber could be performed at any time and creates no obstructions due to the location of the coating chamber 2 aside the tank with molten metal 1.

The lid of the tank with molten metal 1 (or upper part of its wall) is equipped with supplying channel and outtake manifold connected to the compressor to generate the positive pressure in the tank with molten metal.

Both the outtake and intake channels are located in the zone of air cavity above the molten metal level, preferably, in the lid of tank and lid of chamber.

Initially the molten metal levels in the tank 1 and coating chamber 2 are equal due to adjacent location of these sections joint with the inclined intake channel 3 to form the connecting vessels. This level in the coating chamber 2 is below the axes of inlet 4 and outlet 5 channels.

During the unit operation the molten metal level in the coating chamber 2 is lifted up in comparison with the level in the tank with molten metal 1 due to creation of the pressure difference of the tank 1 and chamber 2. Further in the course of operation of the unit the molten metal level is maintained above the axes of the inlet 4 and outlet 5 channels which the wire is moved through in the coating chamber 2.

When positive pressure is generated in tank with molten metal 1 and reduced pressure is generated in coating chamber 2, the additional batch of the molten metal is lifted up along the inclined channel 3 from the tank 1 into the chamber 2, and molten metal level in coating chamber 2 is adjusted above the inlet and outlet channels.

If the condition $P_{st} \geq P_1 + P_{m.col.}$ is satisfied, where $P_{st}$—standard pressure, $P_1$—pressure in the coating chamber, $P_{m.col.}$—metallostatic pressure of the molten metal above the inlet and outlet channels of the coating chamber, then the molten metal even above the inlet and outlet openings does not leak outside.

The coating unit is equipped with an appliance for molten metal control in the coating chamber 2. Molten metal in the coating chamber 2 is used continuously and its level seeks to reduce. If any molten metal level difference occurs, the difference of the standard pressure and pressure in the coating chamber 2 is increased (due to reduction of $P_{m.col.}$), and this could lead to penetration of air (air bubbles) through the inlet or outlet channels of chamber 2 inside the chamber. This fact could disorder the coating process and lead to component coating defects. Air bubbles in the molten metal also cause the contamination of the metal with oxide inclusions and this worsens the coating formation and coating defects occurrence. Any know system could be used to control the metal level in the coating chamber 2.

The invention claimed is:

1. Unit for applying molten metal coatings on lengthy products, comprising:

a tank for molten metal;

a coating chamber with an inlet and an outlet for passing the lengthy product;

an inclined channel between the tank for molten metal and the coating chamber;

the coating chamber and the tank with molten metal are equipped with facilities for creating reduced pressure and positive pressure, respectively, such that molten metal will be supplied from the tank to the coating chamber via the inclined channel;

the inlet and the outlet both being below the level of the molten metal in the coating chamber during coating of the lengthy products;

the tank and the coating chamber being laterally offset with the inclined channel creating connected vessels; and the tank being equipped with a supplying channel to load molten or solid metal into the tank through the supplying channel.

2. Unit according to the claim 1, the supplying channel expands in an upper part facing an upper part of the tank.

3. A unit for applying a coating on a lengthy product, comprising:

a tank containing a molten metal;

a chamber laterally adjacent the tank;

an inclined channel extending between the tank and the chamber to supply molten metal from the tank to the chamber;

the chamber having an inlet and an outlet both located below the level of molten metal in the chamber and through which the lengthy product passes to coat the lengthy product with the molten metal;

the tank having a higher pressure than the chamber; and a supply channel extending into the tank to supply coating material into the tank.

4. The unit of claim 3, the supply channel has an inlet above the tank and an outlet inside the tank below the molten metal surface.

5. The unit of claim 3, wherein the level of molten metal in the chamber is higher than the level of molten metal in the tank.

6. The unit of claim 3, wherein the inlet and the outlet of the chamber each extend horizontally.

7. The unit of claim 3, wherein the inlet and the outlet of the tank reside at the same elevation.

8. The unit of claim 3, wherein the inlet and the outlet of the chamber extend in a common horizontal plane.

9. The unit of claim 3, the inlet and the outlet of the chamber are co-axial with one another.

* * * * *